US006754465B2

(12) United States Patent
Kim

(10) Patent No.: US 6,754,465 B2
(45) Date of Patent: Jun. 22, 2004

(54) LIQUID IMAGE FORMING APPARATUS HAVING SQUEEZE UNIT

(75) Inventor: Yong-su Kim, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/316,856

(22) Filed: Dec. 12, 2002

(65) Prior Publication Data

US 2003/0231903 A1 Dec. 18, 2003

(30) Foreign Application Priority Data

Jun. 12, 2002 (KR) ..... 10-2002-32858

(51) Int. Cl.[7] ..... G03G 15/10
(52) U.S. Cl. ..... 399/237; 399/249
(58) Field of Search ..... 15/256.51, 256.52; 399/237, 238, 239, 240, 245, 249, 230, 233

(56) References Cited

U.S. PATENT DOCUMENTS 5,521,685 A * 5/1996 Barnes et al. ..... 399/237

* cited by examiner

*Primary Examiner*—Hoang Ngo
(74) *Attorney, Agent, or Firm*—Staas & Halsey LLP

(57) ABSTRACT

A liquid image forming apparatus. A developing unit of the liquid image forming apparatus includes a developing container in which a developer is received, a developing roller having a portion which is dipped in the developer of the developing container, which is installed to be opposite to a photosensitive body, a cleaning roller which cleans the developer remaining on the surface of the developing roller after an electrostatic latent image is developed, and a squeeze roller which squeezes the cleaning roller before the developing roller is cleaned, and passes the air passing through the cleaning roller to the outside. The air passing through the cleaning roller does not pass into the developer and thus bubbles are not generated in the developer, thereby solving a problem of non-uniform developer attachment.

9 Claims, 4 Drawing Sheets

LIQUID IMAGE FORMING APPARATUS HAVING SQUEEZE UNIT

CROSS-REFERENCE TO RELATED APPLICATIONS

This application claims the benefit of Korean Application No. 2002-32858, filed Jun. 12, 2002, in the Korean Intellectual Property Office, the disclosure of which is incorporated herein by reference.

BACKGROUND OF THE INVENTION

1. Field of the Invention

The present invention relates to a liquid image forming apparatus, and more particularly, to a liquid image forming apparatus with a dipping-type developing unit in which part of a developing roller is dipped in a developer.

2. Description of the Related Art

Liquid image forming apparatuses such as color laser printers form an electrostatic latent image corresponding to a desired image by radiating light onto a photosensitive body, develop the electrostatic latent image with a developer in which powder-shaped toner is mixed with a liquid solvent, and print the developed electrostatic latent image onto paper.

FIG. 1 shows the structure of a conventional liquid image forming apparatus. The image forming apparatus shown in FIG. 1 includes a laser scanning unit (LSU) 30 to radiate light onto a photosensitive body 40 and form an electrostatic latent image on the photosensitive body 40, a plurality of developing units 10 to develop the electrostatic latent image with developers of predetermined colors, and a transfer unit 20 to transfer the developed image onto a paper S.

As shown in FIG. 2, the developing units 10 include a developing container 16 in which a developer supplied from a cartridge 15 is received, a developing roller 11 having a portion which is dipped in the developer of the developing container 16, which rotates and is opposite to the photosensitive body 40, and a depositing roller 12 which forms a depositing gap G between the depositing roller 12 and the developing roller 11 such that the developer is attached to the surface of the developing roller 11, and forms a potential difference between the depositing roller 12 and the developing roller 11 . The developing units 10 further include a metering roller 13 which regulates the developer stuck on the developing roller 11 within a predetermined range of thickness, an agitator 5 which agitates the developer in the developing container 16, and a cleaning roller 14 which cleans the surface of the developing roller 11. The cleaning roller 14 is formed of a sponge material, rotates in the same direction as the developing roller 11 while contacting the developing roller 11, and cleans toner particles of the undeveloped developer stuck on the developing roller 11.

However, in the image forming apparatus having the above structure, bubbles 17 are generated by the cleaning roller 14 in the developer while the electrostatic latent image formed on the photosensitive body 40 is developed by the developing units 10. That is, the cleaning roller 14 performs a cleaning operation while rotating in the same direction as the developing roller 11. In this case, the water level of the developer becomes uneven, as shown in FIG. 2. Then, part of the cleaning roller 14 is exposed to air, and thus the air passes through pores of the sponge. In addition, the air is passed to the outside by pressure where the cleaning roller 14 is pressed against the developing roller 11, and thus the cleaning roller 14 generates the bubbles 17 in the developer.

Due to this problem, the bubbles 17 enter into the depositing gap G, prevent the toner from being uniformly attached to the developing roller 11, burst on the surface, scatter the developer, and contaminate peripheral devices.

Thus, a structure which can solve the problem caused by generation of the bubbles 17 is required.

SUMMARY OF THE INVENTION

Accordingly, it is an object of the present invention to provide a liquid image forming apparatus having an improved structure in which generation of bubbles in a developer of a developing unit is suppressed.

Additional objects and advantages of the invention will be set forth in part in the description which follows and, in part, will be obvious from the description, or may be learned by practice of the invention.

The foregoing and/or other objects of the present invention are achieved by providing a liquid image forming apparatus including a photosensitive body; a laser scanning unit to radiate light onto the photosensitive body and form an electrostatic latent image on the photosensitive body; a developing unit to develop the electrostatic latent image with a developer having a color; a transfer unit to transfer the developed image onto a paper, wherein the developing unit includes a developing container in which the developer is received, a developing roller having a portion which is dipped in the developer in the developing container, the developing roller being opposite to the photosensitive body, a cleaning roller which cleans the developer remaining on the developing roller after the electrostatic latent image is developed, and a squeeze unit which squeezes the cleaning roller before the developing roller is cleaned, and eliminates air which is in the cleaning roller to an outside.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
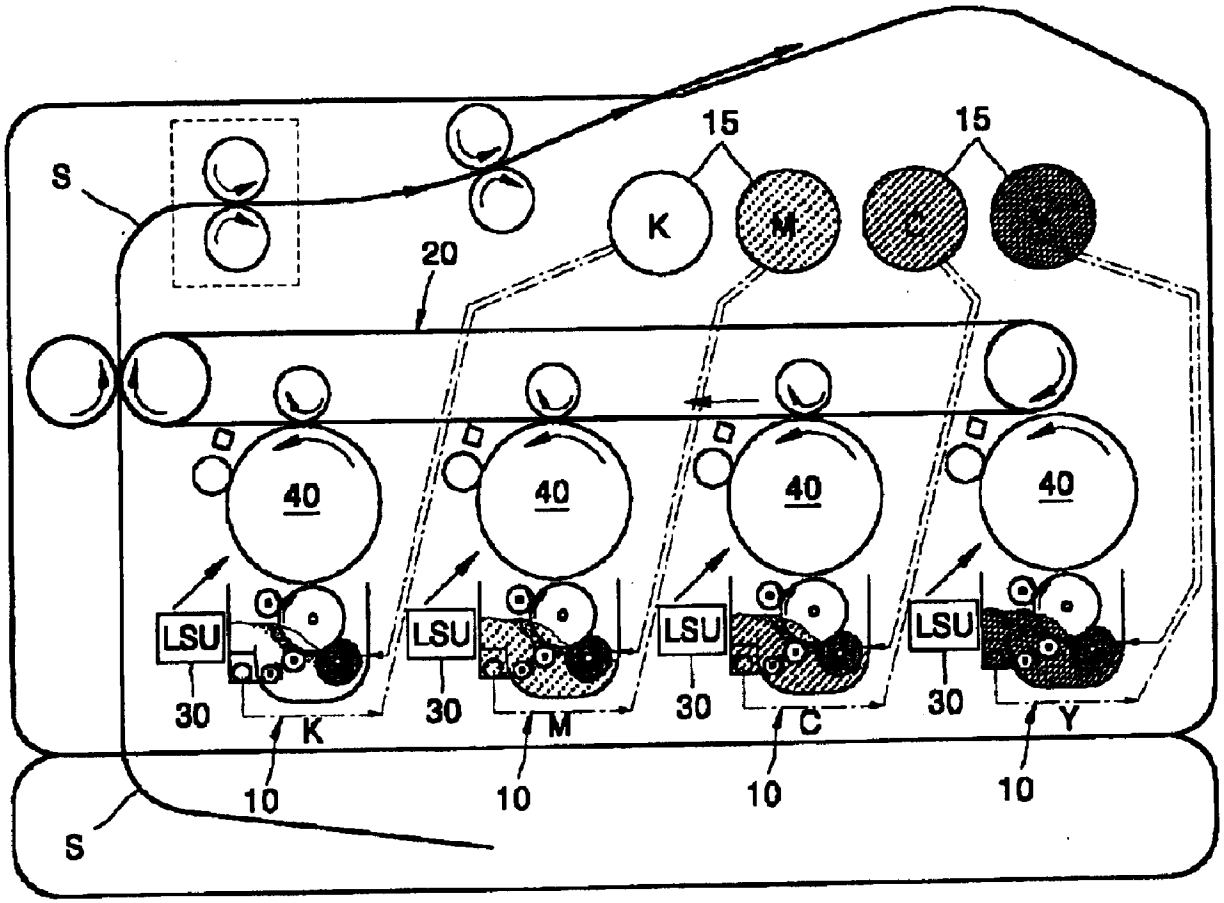
FIG. 1 (PRIOR ART)
FIG. 1 shows a conventional liquid image forming apparatus.
Figure 2:
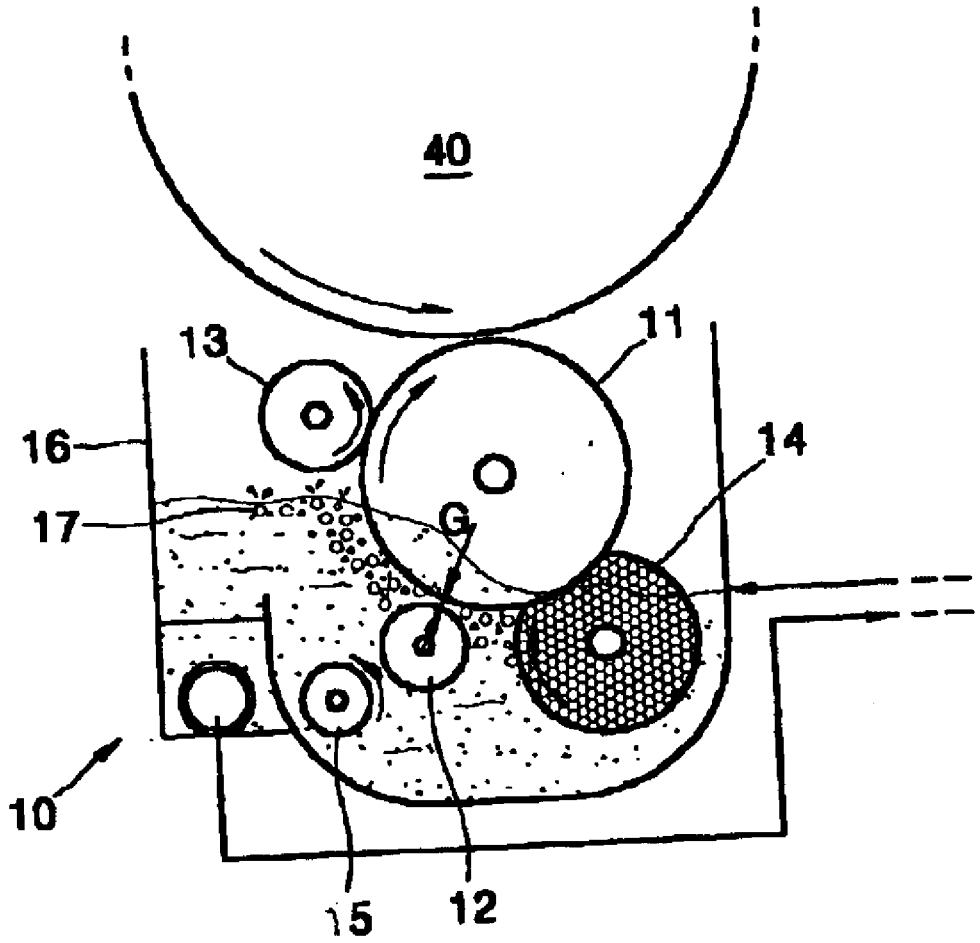
FIG. 2 (PRIOR ART)
FIG. 2 shows a developing unit of the liquid image forming apparatus of FIG. 1.

Reference will now be made in detail to the present preferred embodiments of the present invention, examples of which are illustrated in the accompanying drawings, wherein like reference numerals refer to like elements throughout.

Figure 3:
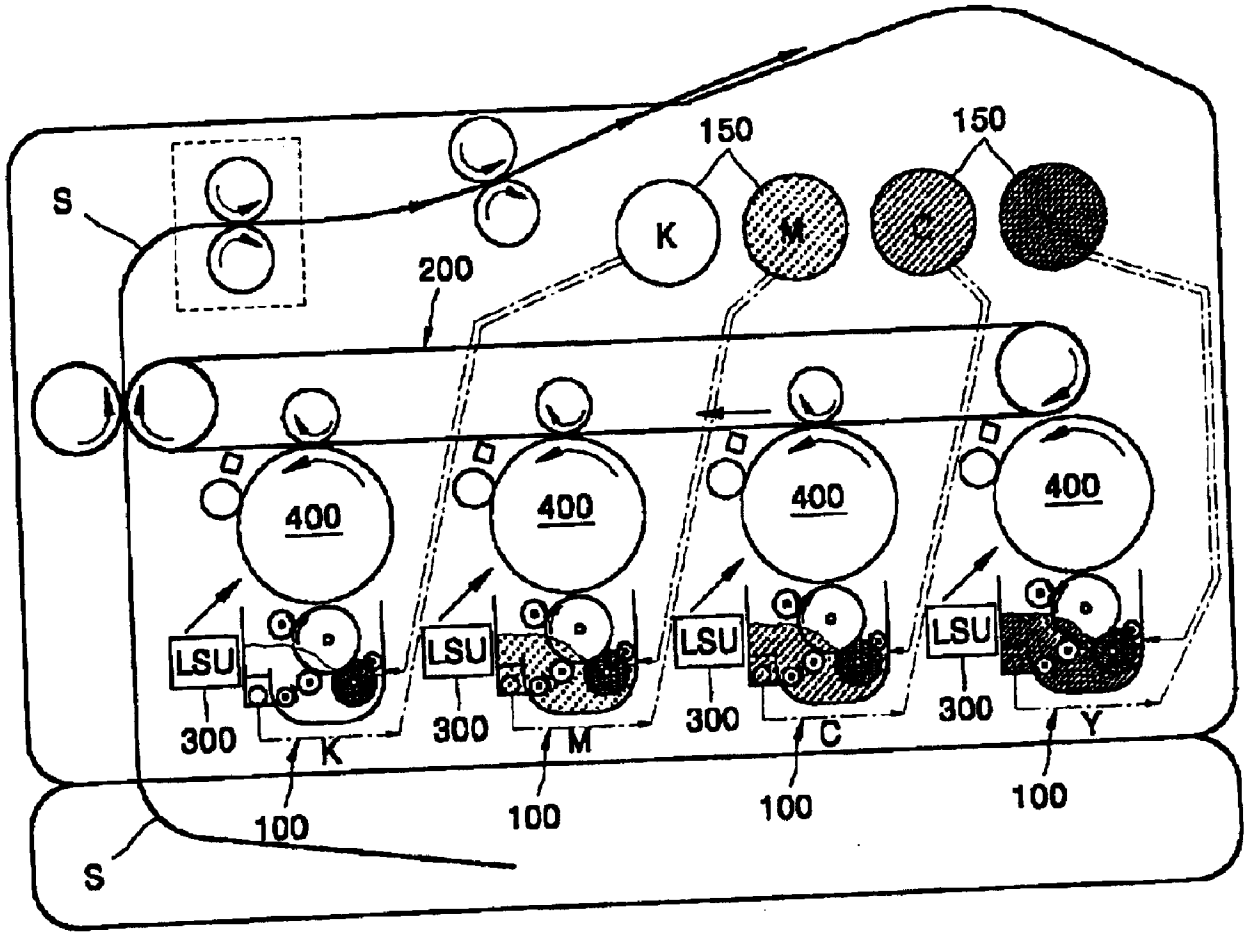
FIG. 3 shows a liquid image forming apparatus according to an embodiment of the present invention.

FIG. 3 shows the internal structure of a liquid image forming apparatus according to an embodiment of the present invention.

As shown in FIG. 3, the liquid image forming apparatus includes a laser scanning unit (LSU) 300 to radiate light onto a photosensitive body 400 and to form an electrostatic latent image on the photosensitive body 400, a plurality of developing units 100 to develop the electrostatic latent image with developers of predetermined colors, and a transfer unit 200 to transfer the developed image onto a paper S.

Here, the developing units 100 include a developing container 160 in which a developer is received, and a developing roller 110 having a portion which is dipped in the developer of the developing container 160, and is opposite to the photosensitive body 400. The developing unit 200 further includes a depositing roller 120 which forms a depositing gap G between the depositing roller 120 and the developing roller 110 such that the developer is attached to the surface of the developing roller 110, and forms a potential difference between the depositing roller 120 and the developing roller 110, a metering roller 130 which regulates the developer stuck on the developing roller 110 within a predetermined range of thickness, an agitator 150 which agitates the developer in the developing container 160, and a cleaning roller 140 which cleans the surface of the developing roller 110. The cleaning roller 140 is formed of a sponge material, rotates in the same direction as the developing roller 110 while contacting the developing roller 110, and cleans toner particles of the undeveloped developer stuck on the developing roller 110. In addition, a squeeze roller 170 is further provided to squeeze a region of the cleaning roller 140.

Figure 4:
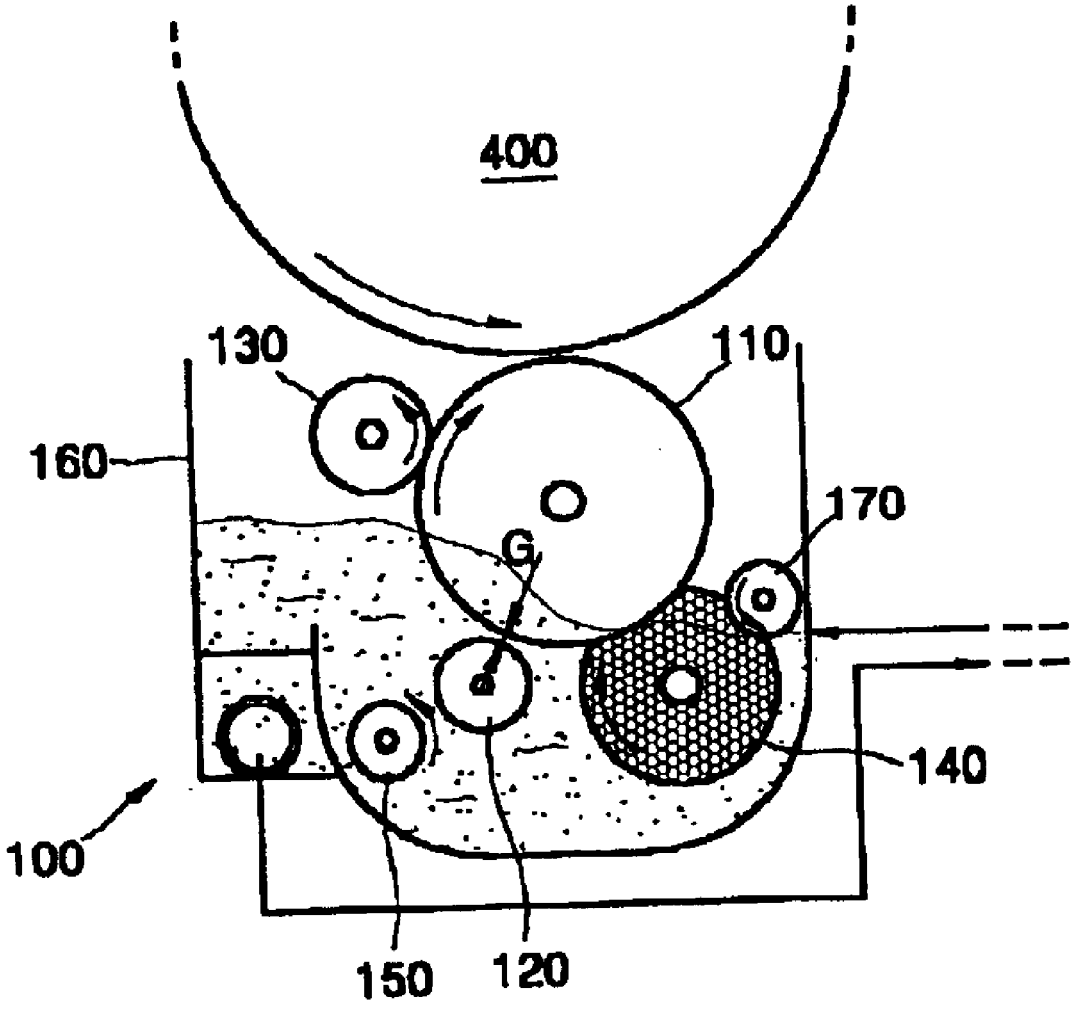
FIG. 4 shows a developing unit of the liquid image forming apparatus of FIG. 3.

Specifically, if the cleaning roller 140 rotates, as shown in FIG. 4, the water level of the developer is not even, and part of the developer is exposed to air. Thus, the squeeze roller 170 is closely attached to the exposed region of the cleaning roller 140, rotates in a direction opposite to that of the cleaning roller 140 and squeezes the cleaning roller 140. As a result, air passing through the exposed region of the cleaning roller 140 is eliminated to the outside before passing into the developer.

In a printing operation using the above structure, the developing units 100 develop the electrostatic latent images that are formed on the photosensitive body 400 by the LSU 300. That is, the developer stuck on the developing roller 110 through the depositing gap G is regulated within a range of uniform thickness by the metering roller 130, accesses the photosensitive body 400 and forms the electrostatic latent image. The developer which does not contribute to this development and remains on the developing roller 110 is later cleaned by the cleaning roller 140 and removed, and the squeeze roller 170 squeezes the region of the cleaning roller 140 exposed to air such that the air is eliminated from the developer.

Therefore, the generation of bubbles in the developer of the developing container 160 during a printing operation is suppressed, and thus a problem of non-uniform developer attachment caused by bubbles in the developer, or bubbles breaking on the surface and thereby scattering the developer, can be solved.

As described above, the liquid image forming apparatus according to the present invention prevents the air passing through the cleaning roller from passing into the developer and thus generating bubbles, thereby the developer is uniformly attached to the developing roller, and contamination of peripheral devices is suppressed.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A liquid image forming apparatus comprising:

a photosensitive body;

a laser scanning unit to radiate light onto the photosensitive body and form an electrostatic latent image on the photosensitive body;

a developing unit to develop the electrostatic latent image with a developer having a color;

a transfer unit to transfer the developed image onto a paper, wherein the developing unit comprises:

a developing container in which the developer is received, a developing roller having a portion which is dipped in the developer in the developing container, the developing roller being opposite to the photosensitive body, a cleaning roller which cleans the developer remaining on the developing roller after the electrostatic latent image is developed, and a squeeze unit which squeezes the cleaning roller before the developing roller is cleaned, and eliminates air which is in the cleaning roller to an outside.

2. The apparatus of claim 1, wherein the squeeze unit comprises a squeeze roller which is attached to the cleaning roller and rotates.

3. The apparatus of claim 1, further comprising:

a depositing roller which forms a depositing gap between the depositing roller and the developing roller such that the developer is attached to the developing roller, and forms a potential difference between the depositing roller and the developing roller;

a metering roller which regulates the developer on the developing roller within a range of thickness; and an agitator which agitates the developer in the developing container.

4. A liquid image forming apparatus comprising:

a developing roller dipped in a developer to develop an electrostatic latent image;

a cleaning roller which cleans the developer remaining on the developing roller after the electrostatic latent image is developed; and a squeeze unit to squeeze the cleaning roller to eliminate air from the cleaning roller.

5. The apparatus of claim 4, wherein the cleaning roller is a sponge.

6. The apparatus of claim 4, wherein the squeeze unit cleans the cleaning roller before the developing roller is cleaned.

7. The apparatus of claim 5, wherein the squeeze unit is a squeeze roller.

8. The apparatus of claim 7, wherein the squeeze roller rotates in a direction opposite to a direction of rotation of the cleaning roller.

9. A liquid image forming apparatus comprising:

a developing roller dipped in a developer to develop an electrostatic latent image;

a cleaning roller which cleans the developer remaining on the developing roller after the electrostatic latent image is developed, the cleaning roller having an exposed portion not dipped in the developer; and an air preventing unit, in contact with the exposed portion of the cleaning roller, to pass air in the exposed portion to an outside before passing into the developer.

* * * * *